US007125110B2

(12) United States Patent
Merz et al.

(10) Patent No.: US 7,125,110 B2
(45) Date of Patent: Oct. 24, 2006

(54) SYSTEMS FOR REGULATING TEMPERATURE IN FLUID EJECTION DEVICES

(75) Inventors: Eric Alan Merz, Palmyra, NY (US); Brian S. Hilton, Rochester, NY (US); Gary A. Kneezel, Webster, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 249 days.

(21) Appl. No.: 10/778,100

(22) Filed: Feb. 17, 2004

(65) Prior Publication Data

US 2005/0179715 A1 Aug. 18, 2005

(51) Int. Cl.
*B41J 2/18* (2006.01)
*B41J 29/38* (2006.01)

(52) U.S. Cl. ..... 347/89; 347/17

(58) Field of Classification Search ..... 347/85, 347/98

See application file for complete search history.

(56) References Cited

U.S. PATENT DOCUMENTS 4,896,172 A * 1/1990 Nozawa et al. ..... 347/17
5,657,061 A * 8/1997 Seccombe et al. ..... 347/18
5,943,078 A * 8/1999 Nishimoto et al. ..... 347/89
5,963,236 A * 10/1999 Miyashita et al. ..... 347/85
6,276,790 B1 * 8/2001 Ikezaki ..... 347/88
6,450,601 B1 * 9/2002 Pagnon et al. ..... 347/7
6,481,830 B1 * 11/2002 Naniwa et al. ..... 347/55
6,655,791 B1 * 12/2003 Crockett et al. ..... 347/85
6,663,233 B1 * 12/2003 Otsuka et al. ..... 347/85
6,742,882 B1 * 6/2004 Nakamura ..... 347/89
6,817,705 B1 * 11/2004 Crockett et al. ..... 347/85
6,880,926 B1 * 4/2005 Childs et al. ..... 347/89

* cited by examiner

*Primary Examiner*—Vip Patel
*Assistant Examiner*—Shelby Fidler
(74) *Attorney, Agent, or Firm*—Oliff & Berridge, PLC

(57) ABSTRACT

Temperature regulating system for use in fluid ejection devices, such as inkjet printing devices, are provided. Such temperature regulating systems can include an ink reservoir, a printhead and optionally an intermediate ink container. Exchange of ink between the ink reservoir, or optionally the intermediate ink container, and the printhead regulates the temperature of the printhead and makes the temperature substantially uniform from drop ejector to drop ejector. Optionally, the ink is transported in a fluid communication path that is in contact with a thermally conductive substrate to further dissipate heat. Printing devices comprising such inkjet cartridges are also provided.

20 Claims, 5 Drawing Sheets

SYSTEMS FOR REGULATING TEMPERATURE IN FLUID EJECTION DEVICES

BACKGROUND OF THE INVENTION

1. Field of Invention

This invention is directed to systems and methods for regulating temperature in fluid ejection devices.

2. Description of Related Art

Inkjet printing devices have gained prominence in printing as result of their capabilities in performing quality, economical color and monochromatic printing. Inkjet printing devices include, but are not limited to, piezoelectric inkjet printing devices and thermal inkjet printing devices. Piezoelectric inkjet devices eject ink from a nozzle by mechanically generating pressure to deform an ink chamber. Thermal inkjet devices eject ink by energizing a heater element to vaporize ink.

In such inkjet printing devices, a printhead, which acts to eject ink onto a recording medium, is comprised of at least one fluid ejecting die module, a substrate to which the die module is bonded, an ink manifold which brings ink to the die module, and electrical interconnection means for enabling the transfer of electrical signals to and from the printhead. The die module typically contains many individual drop ejecting elements, such as piezoelectric actuators or thermal ink jet heaters. In many types of inkjet printheads there is only one die module in the printhead. In other types of inkjet printheads, where it is desired to enable faster printing throughput than can be achieved using a single die module, several die modules are contained within the printhead. Because the fluid ejection process is dependent on the local temperature near the drop ejecting elements, it is important that the temperature be somewhat uniform in the various regions containing drop ejecting elements, whether within a single die module, or among several die modules. In addition, because fluid ejection can become unstable if the temperature gets too high or too low, it is important to keep the temperature within a certain range.

The die module in a thermal inkjet printhead generates significant amounts of residual heat as ink is ejected by heating the ink to the point of vaporization. This residual heat will change the performance, and ultimately the ejection quality, if the excess heat remains within the printhead. Changes in printhead performance are usually manifested by a change in the drop size, firing sequence, or other related ejection metrics. Such ejection metrics desirably stay within a controllable range for acceptable ejection quality. During lengthy operation or heavy coverage ejection, the temperature of the printhead can exceed an allowable temperature limit. Once the temperature limit is exceeded, a slow down or cool down period is normally used to maintain the ejection quality. In addition to self-heating of the printhead, various ambient conditions may make it advantageous to regulate the temperature of an inkjet printhead or other fluid ejection device.

A variety of devices and methods are conventionally used to dissipate heat in an inkjet printhead. Many inkjet printing devices improve throughput by improving thermal performance. One technique to improve printhead performance is to divert excess heat into the ink being ejected. As the hot ink is ejected from the printhead during printing, some amount of printhead cooling occurs as a result. During lengthy operation or heavy coverage ejection, this technique is also susceptible to temperatures in the printhead exceeding an allowable temperature.

Another technique is to attach the die module to a substrate having heat sinking properties. Such substrates store heat and/or conduct heat away from the printhead. Typically, such substrates are made from copper, aluminum or other materials having high thermal conductivity to remove heat from the printhead. U.S. patent application Ser. No. 10/600,507, which is incorporated herein by reference in its entirety, discloses various exemplary embodiments of such substrates molded from a polymer mixed with at least one thermally-conductive filler material.

Thermally conductive substrates, however, add additional weight, size, cost and/or energy usage to the printhead. Each of these becomes disadvantageous when in thermally conductive substrates attached to die modules that are translated past a receiving medium. Moreover, thermally conductive substrates typically dissipate heat via convection, and are inherently ineffective due to their small size.

FIG. 1 is a schematic of a known inkjet printing system 100 showing one method by which ink is conventionally provided to a printhead 130. The system 100 includes a remote ink reservoir 110 and a printhead 130. The printhead is comprised of at least one die module 132, which is bonded to substrate 133, and an ink manifold 131 which brings ink via first fluid communication path 134 to the die module 132. Other components of the printhead 130, such as electrical interconnection means, are not shown. Typically, the remote ink reservoir 110 contains a much larger volume of ink than the ink manifold 131. The remote ink reservoir 110 can be 10 to 1000 times as large as the ink manifold 131. In the case of a scanning type of printhead, this type of ink supply configuration allows the mass of the moving printhead to remain small so that accelerations and decelerations of the scanning printhead do not exert unacceptably large forces on the printer. For either a scanning type of printhead or a stationary type of printhead, there is also typically not enough space near the printhead to store the entire supply of ink. The ink reservoir 110 and the ink manifold 131 are connected by a second fluid communication path 150. The second fluid communication path 150 allows ink stored in the ink reservoir 110 to be provided to the ink manifold 131. The ink is then supplied to the die module 132 as necessary to effect ejection of the ink from the printhead 130 onto a recording medium.

Inkjet printing systems, such as shown in FIG. 1, are limited in their ability to dissipate heat. Such systems are limited because heat can only be dissipated via contact between the printhead and the thermally conductive substrate, and through ejection of ink during printing operations.

SUMMARY OF THE INVENTION

Notwithstanding the merits of the above methods, there is still a need for additional suitable ways to regulate temperature in fluid ejection systems, such as inkjet printheads. The present invention meets this need by providing systems, methods and structures in which fluid that is present in a fluid ejection system (e.g., ink exchanged between an ink reservoir and a printhead) is used to bring the temperature of a fluid ejector (e.g., a printhead) closer to that of the ink reservoir, for example by carrying heat away from the fluid ejector by recirculation. By carrying fluid in the fluid ejector to other parts of the fluid ejection system and/or to locations remote from the fluid ejector, heat in the fluid ejector is dissipated.

The present invention is directed to systems, methods and structures for regulating temperature in fluid ejection systems.

The present invention separately provides systems, methods and structures for regulating temperature of a fluid ejection system using a recirculating fluid supply.

The present invention separately provides a fluid ejection system having a thermally conductive mass associated with a heat generating fluid ejector. In various exemplary embodiments, the recirculating fluid supply can be contacted with the thermally conductive mass to dissipate heat. The present invention is also directed to inkjet printheads, ink supply subsystems and inkjet printing devices including such systems.

Various exemplary embodiments of the temperature regulating systems according to this invention include an ink reservoir and a printhead which are connected by two fluid communication paths: a first fluid communication path for providing ink from the ink reservoir to the printhead and a second fluid communication path for returning ink from the printhead to the ink reservoir. In various exemplary embodiments, the fluid communication path for supplying ink to the printhead and/or the fluid communication path for returning ink from the printhead to the ink reservoir are in contact with a thermally conductive substrate.

Further exemplary embodiments of the temperature regulating systems according to this invention include an ink reservoir, an intermediate ink container and a printhead. In various exemplary embodiments, the ink reservoir and the intermediate ink container are connected by two fluid communication paths: a first fluid communication path for providing ink from the ink reservoir to the intermediate ink container and a second fluid communication path for returning ink from the intermediate ink container to the ink reservoir. In various exemplary embodiments, the intermediate ink container and the printhead are connected by two fluid communication paths: a first fluid communication path for providing ink from the intermediate ink container to the print head and a second fluid communication path for returning ink from the printhead to the intermediate ink container. In various exemplary embodiments, the fluid communication path for returning ink from the intermediate ink container to the ink reservoir and/or the fluid communication path for delivering ink from the ink reservoir to the intermediate ink container are in contact with a thermally conductive substrate.

In various exemplary embodiments, the inkjet printheads and ink supply subsystems according to this invention are manufactured to include the temperature regulating systems according to this invention.

In various exemplary embodiments, the printing devices according to this invention include inkjet printheads and ink supply subsystems manufactured employing the temperature regulating systems according to this invention.

For a better understanding of the invention as well as other aspects and further features thereof, reference is made to the following drawings and descriptions.

BRIEF DESCRIPTION OF THE DRAWINGS

Various exemplary embodiments of the invention will be described in detail with reference to the following figures, wherein.

DETAILED DESCRIPTION OF EXEMPLARY EMBODIMENTS

Figure 2:
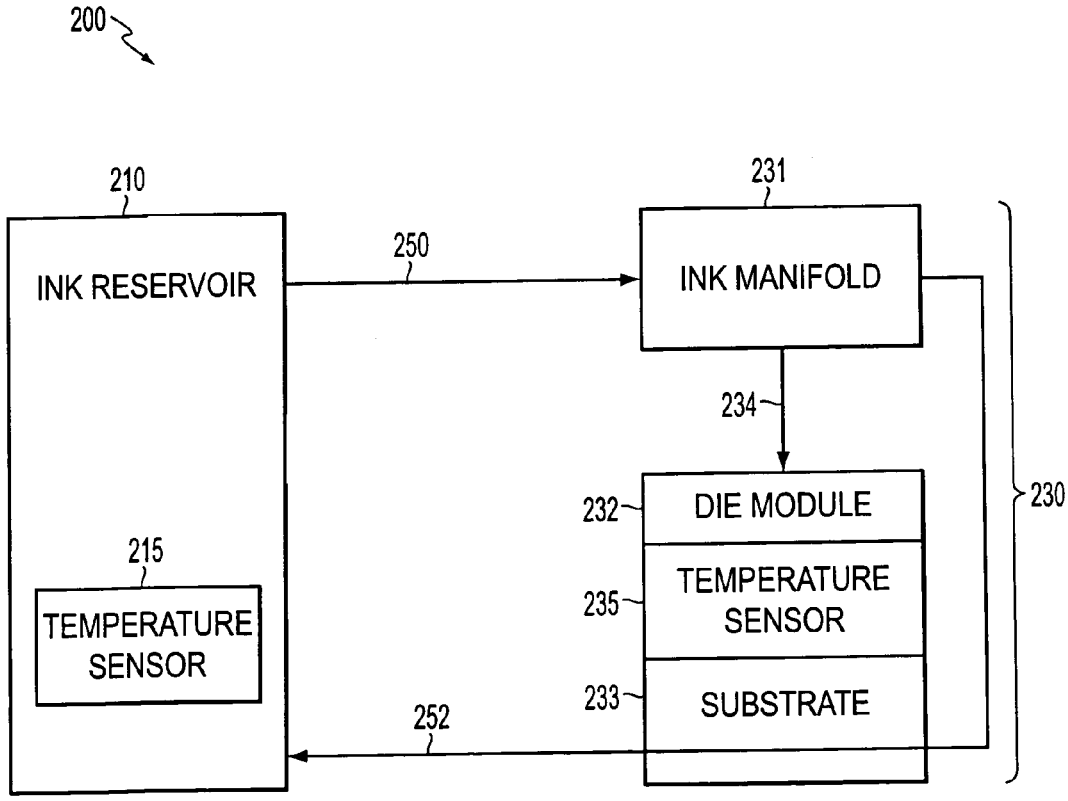
FIG. 2 shows a schematic of an exemplary embodiment of a temperature regulating system for an inkjet printing device according to this invention.

FIG. 2 is a schematic of an exemplary embodiment of a temperature regulating system 200 for an inkjet printing device according to this invention showing how ink is provided to the printhead 230. The temperature regulating system 200 includes an ink reservoir 210 with optional first temperature sensor 215, a printhead 230, a first fluid communication path 250, and second fluid communication path 252. The printhead 230 is comprised of at least one die module 232 which is bonded to thermally conductive substrate 233, and an ink manifold 231 which supplies ink to the die module 232 via a third fluid communication path 234. The second fluid communication path 252 is in contact with the thermally conductive substrate 233. Optionally there is a second temperature sensor 235 in the printhead 230. In various exemplary embodiments, the second temperature sensor 235 is located on the die module 232 or the thermally conductive substrate 233. In further exemplary embodiments, the second temperature sensor 235 is located in or adjacent to the ink manifold 231.

In operation, ink for use in printing originates in the ink reservoir 210. The ink is transported from the ink reservoir 210 to the printhead 230 via the first fluid communication path 250. Some portion of the ink provided to the printhead 230 is ejected onto a recording medium. Excess ink can be returned from the printhead 230 to the ink reservoir 210 via the second fluid communication path 252. As discussed above, operation of the printhead 230 generates heat that can adversely affect printing. Either as a matter of course, or when a temperature outside an acceptable range is detected by the first temperature sensor 215 and/or the second temperature sensor 235, ink can be transported from the printhead 230 to the ink reservoir 210 via the second fluid communication path 252. The ink, when transported from printhead 230 to the ink reservoir 210, carries heat energy generated by the printhead 230 away from the printhead 230. The ink reservoir 210 is generally substantially larger than the ink manifold 231 and, especially in the case of thermal printheads, generally contains ink existing at a lower temperature than ink arriving from the printhead 230. Accordingly, when the relatively small amount of hot ink in the printhead 230 joins the relatively larger volume of ink in the ink reservoir 210 the heat energy is dissipated into a larger volume of ink. After the hot ink has been transported from the printhead 230 to the ink reservoir 210, and when additional ink for printing is needed, ink is again transported from the ink reservoir 210 to the printhead 230 via the first fluid communication path 250.

Figure 1:
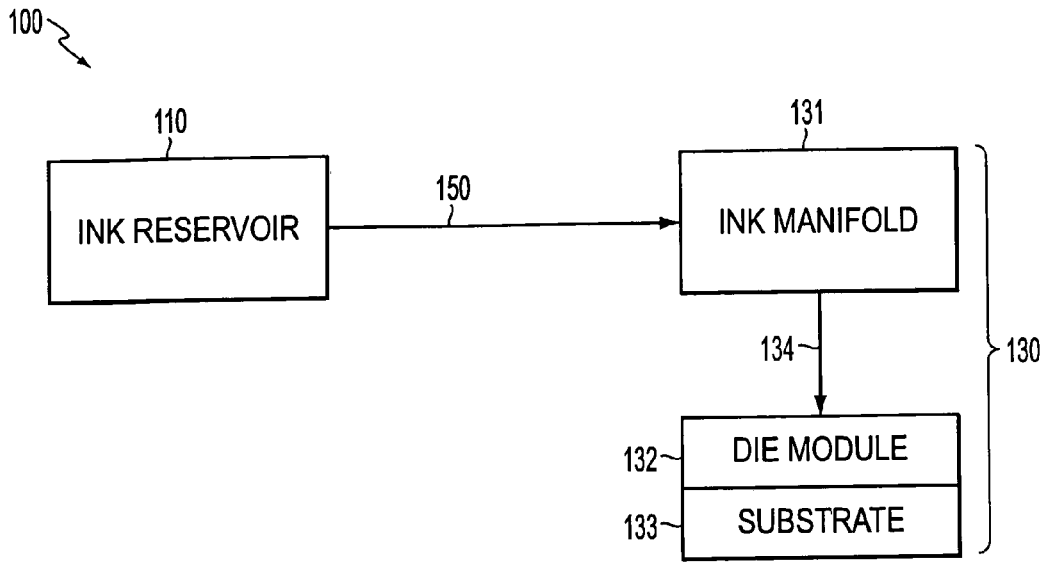
FIG. 1 PRIOR ART
FIG. 1 shows a schematic of a known inkjet printing system.

Since additional amounts of heat can be carried away from a hot printhead, temperature can be better controlled than in the configuration shown in FIG. 1. This allows for extended printing without encountering heat effects in the printhead which would tend to degrade print quality. Of course, in other types of fluid ejection systems, a fluid ejector may not generate excessive heat. In such systems, it may still be useful to maintain the temperature of the fluid ejector at a substantially uniform level and/or within a given desired temperature range. While the exemplary embodiment described above is applicable to the case of dissipating excessive heat generated by a printhead, a more general case is that of maintaining the temperature of a fluid ejection system within a desirable temperature range which may be higher or may be lower than a fluid ejector, such as a printhead, would otherwise tend to reach, depending on ambient conditions and heat dissipation in the system.

In various exemplary embodiments, the temperature regulating system for an inkjet printing device according to this invention includes a printhead and a separate ink reservoir. The printhead can include one or more die modules and an ink manifold. In various exemplary embodiments, the ink reservoir and printhead can be situated and shaped in any suitable manner that permits ink storage and allows printing to be accomplished.

In various exemplary embodiments, the fluid communication paths for connecting the ink reservoir and the printhead are any type of fluid communication path suitable for linking the ink reservoir and printhead together and for storing and transporting ink. In various exemplary embodiments, the conduits can be flexible tubing. In various exemplary embodiments, the conduits can include valves for regulating the flow of ink. In various exemplary embodiments, one fluid communication path capable of controlled transport of ink to and from a location can be used in lieu of two separate fluid communication paths each capable of unidirectional transport.

In various exemplary embodiments, the ink reservoir, printhead and fluid communication paths therebetween can be formed from any one or more materials suitable for storing and/or transporting ink, and for performing printing functions. In various exemplary embodiments, the ink reservoir and ink manifold can be formed from heat resistant polymers. In various exemplary embodiments, the fluid communication paths can be formed from heat resistant elastomers.

In various exemplary embodiments, the thermally conductive substrate can be situated and shaped in any suitable manner that permits heat generated by the printhead to be dissipated. In various exemplary embodiments, the thermally conductive substrate is directly attached or bonded to the printhead through a thermally conductive bond. In various exemplary embodiments, the thermally conductive substrate is formed from a material having good heat conductivity. In some such embodiments, the thermally conductive substrate may be formed from aluminum, copper and/or a thermally conductive polymer. The temperature sensor can be any known or later developed device or apparatus for detecting and reporting temperature.

In the exemplary embodiment shown in FIG. 2, ink travels to and from the ink reservoir via the first fluid communication path 250, which carries ink from the ink reservoir 210 to the ink manifold 231, and via the second fluid communication path 252, which carries ink from the ink manifold 231 through or across the thermally conductive substrate 233, and on to the ink reservoir 210. By directing the ink to flow through or across the thermally conductive substrate 233, the transfer of heat from the printhead 230 to the ink reservoir 210 is enabled to be more efficient. In some exemplary embodiments, the second fluid communication path 252 proceeds directly from ink manifold 231 to ink reservoir 210, without contacting the thermally conductive substrate 233.

In the exemplary embodiment shown in FIG. 2, the first fluid communication path 250 proceeds from the ink reservoir 210 to the ink manifold 231. From there, the ink proceeds via the third fluid communication path 234 to the die module 232 for printing, and also via the second fluid communication path 252 across or through the thermally conductive substrate 233 for cooling by ink flow. The ink then proceeds via the second fluid communication path 252 from the thermally conductive substrate 233 to the ink reservoir 210. The second fluid communication path 252 can, of course, include two separate conduits, one leading from the ink manifold 231 to the thermally conductive substrate 233 and a second leading from the thermally conductive substrate 233 to the ink reservoir 210.

Figure 3:
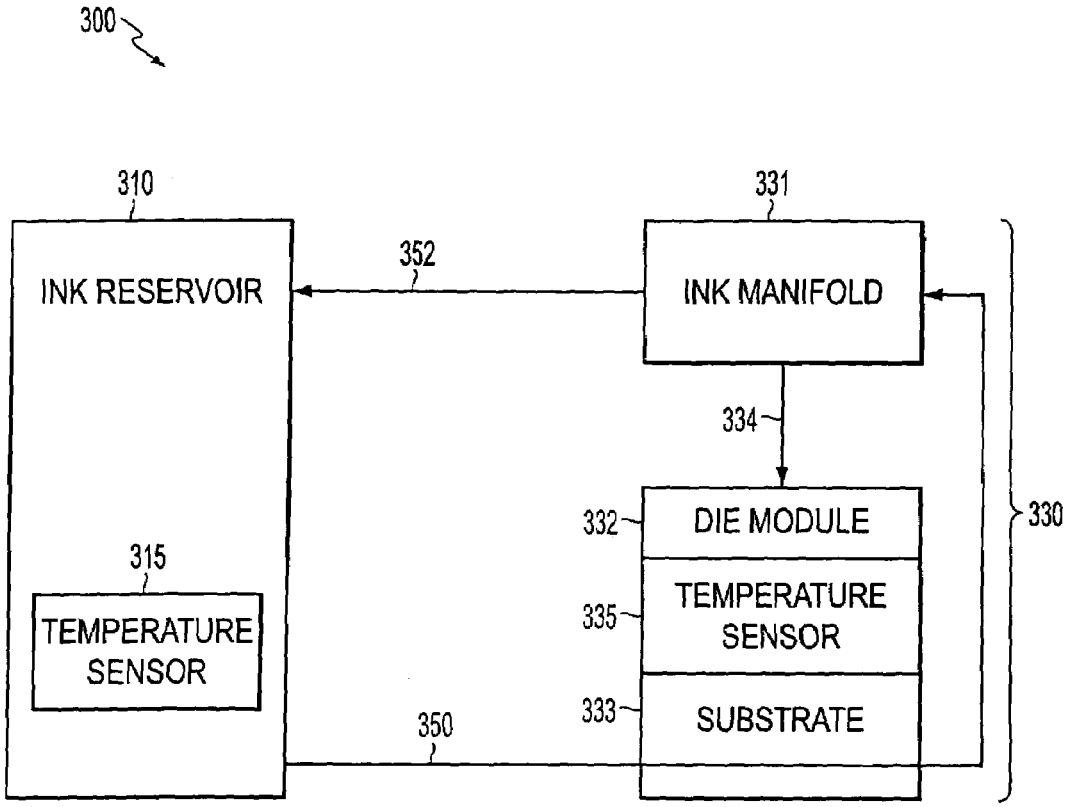
FIG. 3 shows a schematic of an exemplary embodiment of a temperature regulating system for an inkjet printing device according to this invention.

FIG. 3 is a schematic of an exemplary embodiment of a temperature regulating system 300 for an inkjet printing device according to this invention showing how ink is provided to the printhead 330. The temperature regulating system 300 includes an ink reservoir 310 with optional first temperature sensor 315, a printhead 330, a first fluid communication path 350, and second fluid communication path 352. The printhead 330 is comprised of at least one die module 332 which is bonded to thermally conductive substrate 333, and an ink manifold 331 which supplies ink to the die module 332 via a third fluid communication path 334. The first fluid communication path 350 is in contact with the thermally conductive substrate 333. Optionally there is a second temperature sensor 335 in the printhead 330.

In operation, the exemplary embodiment shown in FIG. 3 functions similarly to the exemplary embodiment shown in FIG. 2. However, the direction of ink flow is reversed. The first fluid communication path 350 carries ink from the ink reservoir 310 and across or through the thermally conductive substrate 333. From there, the first fluid communication path 350 carries the ink to the ink manifold 331. Some of the ink is carried via the third fluid communication path 334 to die module 332 for printing, while some of the ink is returned to ink reservoir 310 via the second fluid communication path 352. The first fluid communication path 350 can, of course, include two separate conduits, one leading from the ink reservoir 310 to the thermally conductive substrate 333 and a second leading from the thermally conductive substrate 333 to the ink manifold 331.

Figure 4:
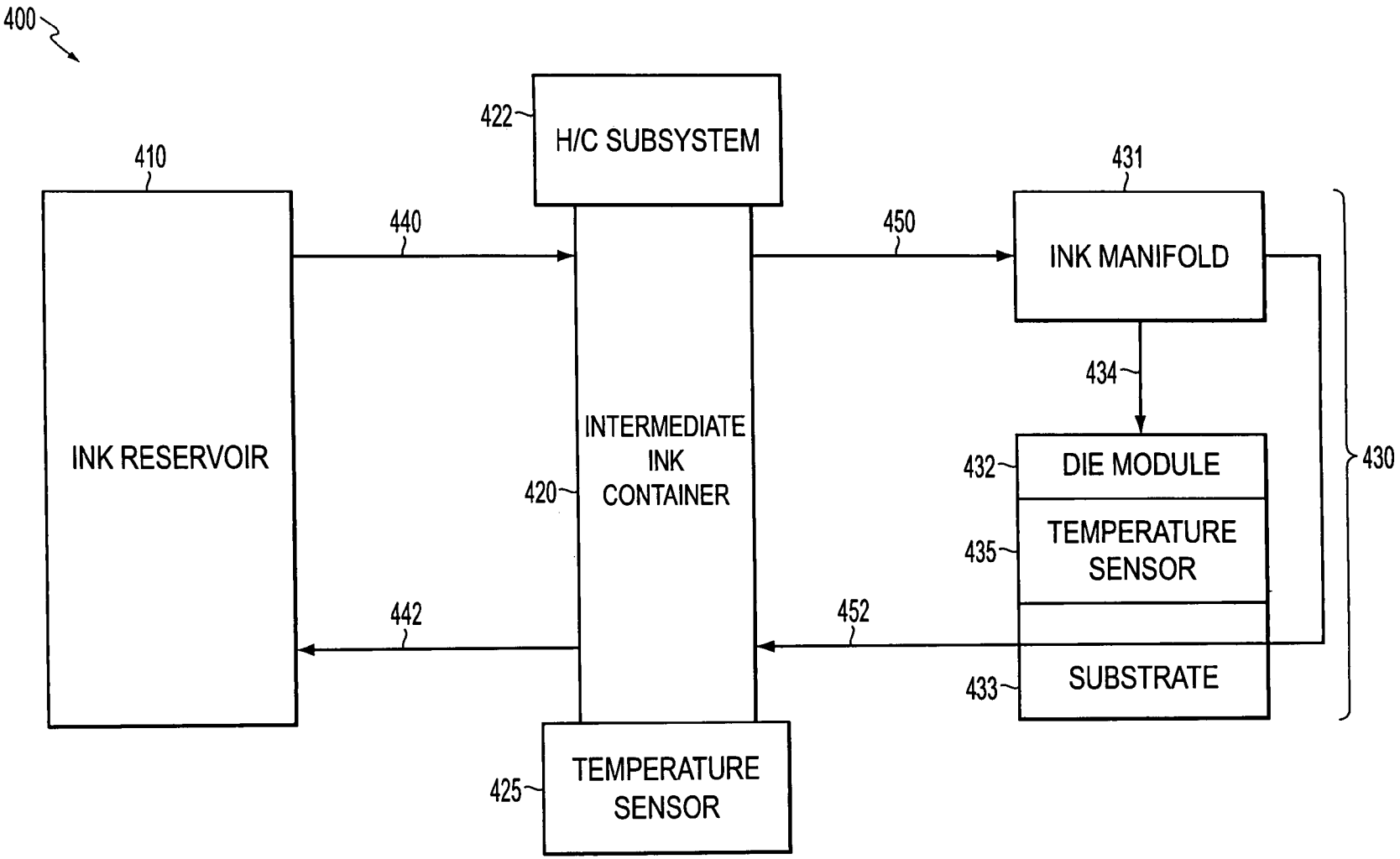
FIG. 4 shows a schematic of an exemplary embodiment of a temperature regulating system for an inkjet printing device according to this invention.

FIG. 4 is a schematic of an exemplary embodiment of a temperature regulating system 400 for an inkjet printing device according to this invention showing how ink is provided to the printhead 430. The temperature regulating system 400 includes an ink reservoir 410, an intermediate ink container 420, and a printhead 430. The printhead 430 includes an ink manifold 431, a die module 432 and a thermally conductive substrate 433. The thermally conductive substrate 433 is directly attached or bonded to the die module 432 through a thermally conductive bond. The ink reservoir 410 and the intermediate ink container 420 are connected by a first fluid communication path 440. The first fluid communication path 440 allows ink stored in the ink reservoir 410 to be provided to the intermediate ink container 420. The intermediate ink container 420 typically contains a much lower volume of ink than the ink reservoir 410, so that it may reach a desired thermal steady state more rapidly. In addition, intermediate ink container 420 optionally includes a temperature sensor 425 and a heating or cooling subsystem 422. The heating or cooling subsystem 422 may include cooling fans, thermoelectric coolers, electric heaters or other such means to raise or lower the temperature of the ink in the intermediate ink container 420, together with optional temperature control circuitry. The intermediate ink container 420 and the printhead 430 are connected by a second fluid communication path 450 and a third fluid communication path 452. The second fluid communication path 450 allows ink stored in the intermediate ink container 420 to be provided to the printhead 430. The third fluid communication path 452 allows ink present in the printhead 430 to be returned to the intermediate ink container 420. The intermediate ink container 420 and the ink reservoir 410 are connected by a fourth fluid communication path 442. The fourth fluid communication path 442 allows ink in the intermediate ink container 420 to be returned to the ink reservoir 410.

In operation, ink for use in printing originates in the ink reservoir 410. The ink is transported from the ink reservoir 410 to the intermediate ink container 420 via the first fluid communication path 440. Ink temperature may optionally be controlled in the intermediate ink container using the heating or cooling subsystem 422. When required for printing, the ink is transported from the intermediate ink container 420 to the printhead 430 via the second fluid communication path 450. Some portion of the ink provided from the ink manifold 431 to the die module 432 via a fifth fluid communication path 434, and is ejected onto a recording medium. Excess ink, and the associated heat energy generated by the printhead 430 can be returned from the printhead 430 to the intermediate ink container 420 via the third fluid communication path 452. Either as a matter of course, or when excess heat is detected, ink can be transported from the intermediate ink container 420 to the ink reservoir 410 via the fourth fluid communication path 442. The ink reservoir 410 is generally at a lower temperature than the ink in the intermediate ink container, and is remote from the printhead 430. Accordingly, when the hot ink in the intermediate ink container 420 is transported to the ink reservoir 410, the heat energy is dissipated. After the ink has cooled, at least to some extent, it is transferred from the ink reservoir 410 to the intermediate ink container 420 via the first fluid communication path 440.

In the exemplary embodiment shown in FIG. 4, ink travels between the intermediate ink container 420 and the printhead 430 via the second fluid communication path 450, which carries ink from the intermediate ink container 420 to the ink manifold 431, and via the third fluid communication path 452, which carries ink from the ink manifold 431 through or across the thermally conductive substrate 433, and on to the intermediate ink container 420. By directing the ink to flow through or across the thermally conductive substrate 433, the transfer of heat from the printhead 430 to the ink reservoir 410 is enabled to be more efficient. In some exemplary embodiments, the third fluid communication path 452 proceeds directly from ink manifold 431 to the intermediate ink container 420, without contacting the thermally conductive substrate 433. The second fluid communication path 452 can, of course, include two separate conduits, one leading from the ink manifold 431 to the thermally conductive substrate 433 and a second leading from the thermally conductive substrate 433 to the intermediate ink container 210.

In various exemplary embodiments, the intermediate ink container, like the ink reservoir and printhead, can be situated and shaped in any suitable manner that permits ink storage and allows printing to be accomplished. In various exemplary embodiments, the temperature regulating system for an inkjet printing device according to this invention includes a printhead, a separate ink reservoir and a separate intermediate ink container.

In various exemplary embodiments, the fluid communication paths for connecting the ink reservoir to the intermediate ink container are any type of fluid communication paths suitable for linking those elements and for storing and transporting ink. In various exemplary embodiments, the conduits can be flexible tubing. In various exemplary embodiments the conduits can include valves for regulating the flow of ink.

In various exemplary embodiments, the intermediate ink container and the conduits between the intermediate ink container and the ink reservoir can be formed from any one or more materials suitable for storing and/or transporting ink, and for performing printing functions. In various exemplary embodiments, the intermediate ink container can be formed from a heat resistant polymer. In various exemplary embodiments, the fluid communication paths can be formed from heat resistant elastomers. In various exemplary embodiments, the intermediate ink container may be formed from a thermally conductive material, such as metal or a conductive polymer, so as to serve as a thermally conductive substrate releasing heat from the ink to ambient air.

Figure 5:
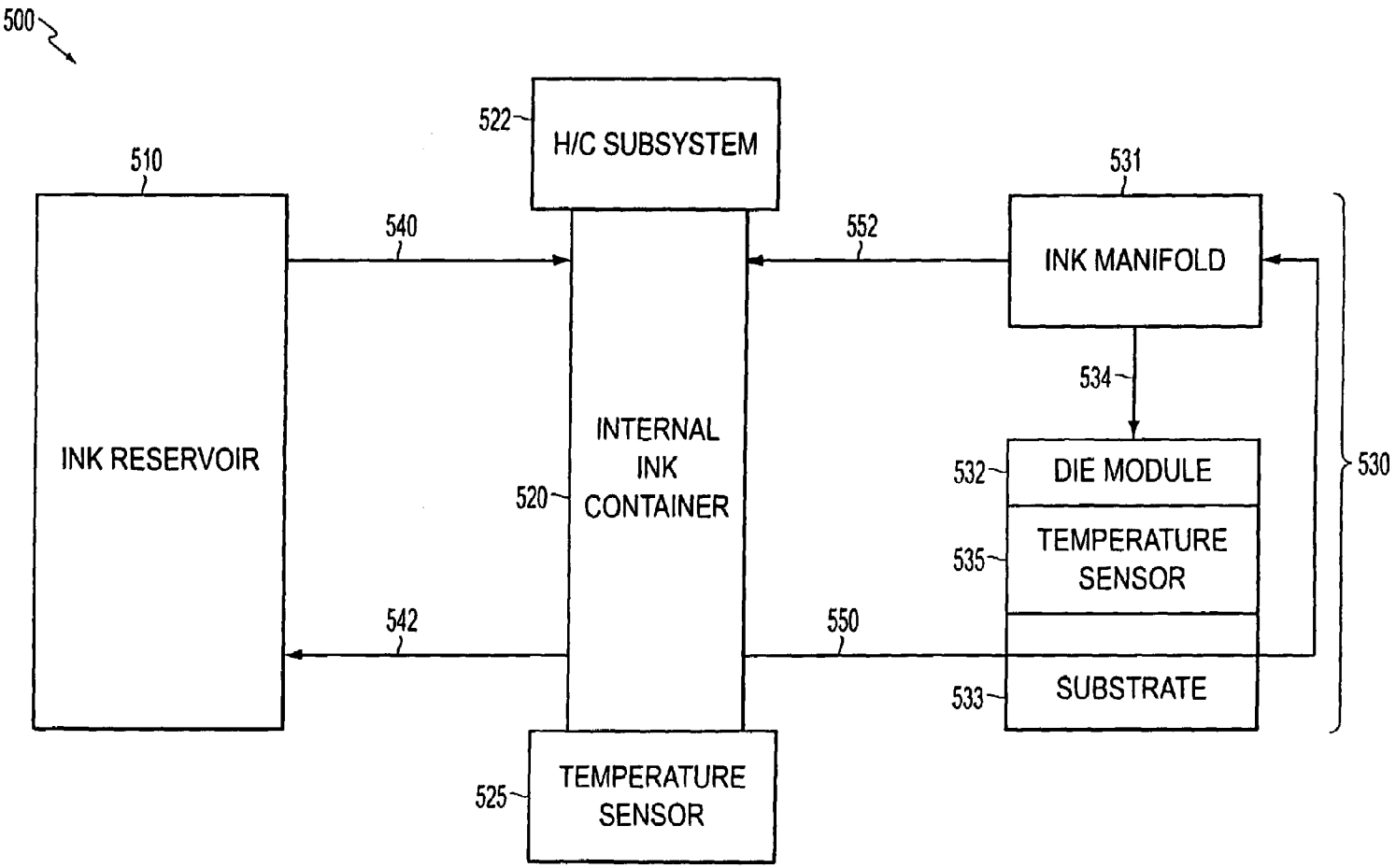
FIG. 5 shows a schematic of an exemplary embodiment of a temperature regulating system for an inkjet printing device according to this invention.

FIG. 5 is a schematic of an exemplary embodiment of a temperature regulating system 500 for an inkjet printing device according to this invention showing how ink is provided to the printhead 530. The temperature regulating system 500 includes an ink reservoir 510, an intermediate ink container 520, and a printhead 530. The printhead 530 includes an ink manifold 531, a die module 532 and a thermally conductive substrate 533. The thermally conductive substrate 533 is directly attached or bonded to the die module 532 through a thermally conductive bond. The ink reservoir 510 and the intermediate ink container 520 are connected by a first fluid communication path 540. The first fluid communication path 540 allows ink stored in the ink reservoir 510 to be provided to the intermediate ink container 520. The intermediate ink container 520 optionally includes a temperature sensor 525 and a heating or cooling subsystem 522. The heating or cooling subsystem 522 may include cooling fans, thermoelectric coolers, electric heaters or other such means to raise or lower the temperature of the ink in the intermediate ink container 520, together with optional temperature control circuitry. The intermediate ink container 520 and the printhead 530 are connected by a second fluid communication path 550 and a third fluid communication path 552. The second fluid communication path 550 allows ink stored in the intermediate ink container 520 to be provided to the printhead 530. The third fluid communication path 552 allows ink present in the printhead 530 to be returned to the intermediate ink container 520. The intermediate ink container 520 and the ink reservoir 510 are connected by a fourth fluid communication path 542. The fourth fluid communication path 542 allows ink in the intermediate ink container 520 to be returned to the ink reservoir 510.

In operation, the exemplary embodiment shown in FIG. 5 functions similarly to the exemplary embodiment shown in FIG. 4. However, the direction of ink flow between the intermediate ink container 520 and the ink manifold 531 is reversed. The second fluid communication path 550 carries ink from the intermediate ink container 520 and across or through the thermally conductive substrate 533. From there, the second fluid communication path 550 carries the ink to the ink manifold 531. Some of the ink is carried via a fifth fluid conmmnication path 534 to die module 532 for printing, while some of the ink is returned to intermediate ink container 520 via the third fluid communication path 552. The second fluid communication path 550 can, of course, include two separate conduits, one leading from the intermediate ink container 520 to the thermally conductive substrate 533 and a second leading from the thermally conductive substrate 533 to the ink manifold 531.

As described above, in various exemplary embodiments, one or more of the fluid communication paths contacts the thermally conductive substrate. FIGS. 6–8 show various exemplary ways in which such contact between the fluid communication path and the thermally conductive substrate can be made. As the surface area of the portion of the fluid communication path in contact with the thermally conductive substrate is increased (e.g., by forming at least part of the fluid communication path inside of the thermally conductive substrate or increasing the length of the portion of the fluid communication path in contact with the thermally conductive substrate), the heat dissipating effect of that contact is increased. The configurations of fluid communication path and thermally conductive substrate shown in FIGS. 6–8 are not intended to limit the scope of the present invention. Numerous variations on the configurations shown in FIGS. 6–8 will be apparent to those of ordinary skill in the art.

Figure 6A:
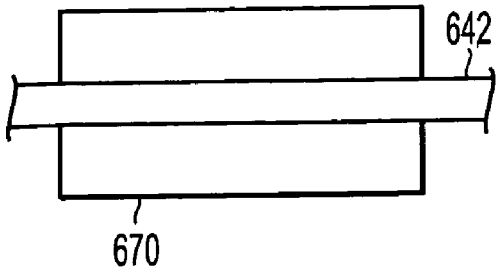
FIG. 6A shows a front cross-section view of an exemplary embodiment of a thermally conductive substrate according to this invention.
Figure 6B:
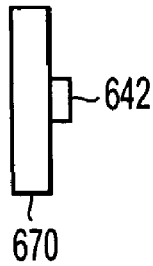
FIG. 6B shows a side cross-section view of an exemplary embodiment of a thermally conductive substrate according to this invention.

FIGS. 6A and 6B show an exemplary embodiment of a thermally conductive substrate 670 according to this invention. The thermally conductive substrate 670 is in contact with a fluid communication path 642. In this embodiment, a portion of an outside surface of the fluid communication path 642 contacts a planar surface of the thermally conductive substrate 670.

Figure 7A:
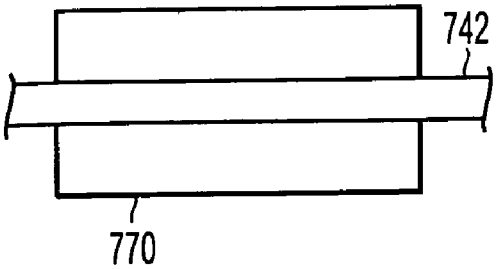
FIG. 7A shows a front cross-section view of an exemplary embodiment of a thermally conductive substrate according to this invention.
Figure 7B:
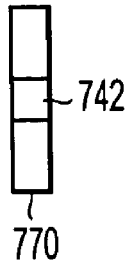
FIG. 7B shows a side cross-section view of an exemplary embodiment of a thermally conductive substrate according to this invention.

FIGS. 7A and 7B show an exemplary embodiment of a thermally conductive substrate 770 according to this invention. The thermally conductive substrate 770 is in contact with a fluid communication path 742. In this embodiment, a portion of the fluid communication path 742, is internal to the thermally conductive substrate 770.

Figure 8A:
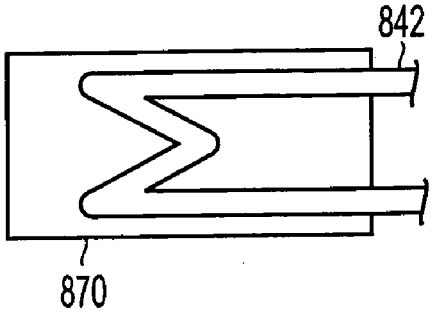
FIG. 8A shows a front cross-section view of an exemplary embodiment of a thermally conductive substrate according to this invention.
Figure 8B:
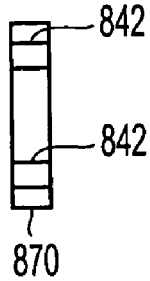
FIG. 8B shows a side cross-section view of an exemplary embodiment of a thermally conductive substrate according to this invention.

FIGS. 8A and 8B show an exemplary embodiment of a thermally conductive substrate 870 according to this invention. The thermally conductive substrate 870 is in contact with a fluid communication path 842. In this embodiment, a portion of the fluid communication path 842 is internal to the thermally conductive substrate 870. The portion of the fluid communication path 842 internal to the thermally conductive substrate 870 may be curved, coiled, sinusoidal or other-shaped, so as to increase the surface area of the fluid communication path 842 that is in contact with the thermally conductive substrate 870.

While this invention has been described in conjunction with the exemplary embodiments outlined above, various alternatives, modifications, variations, improvements, and/or substantial equivalents, whether known or that are or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the claims as filed and as they may be amended are intended to embrace all known or later developed alternatives, modifications, variations, improvements, and/or substantial equivalents.

What is claimed is:

1. A temperature regulating system for a fluid ejection device, comprising:
- a fluid reservoir;
- a fluid ejection device;
- a first temperature sensor configured to detect a temperature of fluid in the fluid ejection device;
- a second temperature sensor configured to detect a temperature of the fluid in the fluid reservoir; and
- at least one fluid communication path for carrying fluid between the fluid reservoir and the fluid ejection device;
- wherein the temperature regulating system causes fluid not ejected by the fluid ejection device to be recirculated based on the fluid temperatures detected by the first and second temperature sensors to regulate the temperature of the fluid ejection device to be within a predetermined temperature range.

2. The temperature regulating system of claim 1, further comprising a thermally conductive substrate as a component of the fluid ejection device.

3. The temperature regulating system of claim 2, wherein the thermally conductive substrate is thermally coupled to both the fluid ejection device and at least one of the at least one fluid communication paths.

4. The temperature regulating system of claim 2, wherein at least a portion of the at least one fluid communication path is in contact with the thermally conductive substrate.

5. The temperature regulating system of claim 4, wherein at least a portion of the at least one fluid communication path is internal to the thermally conductive substrate.

6. The temperature regulating system of claim 1, wherein the temperature regulating system causes the fluid to be carried from the fluid ejection device to the fluid reservoir when a predetermined temperature is detected by at least one of the first and second temperature sensors.

7. The temperature regulating system of claim 1, wherein the fluid ejection device is a thermal ink jet printhead having at least one die module.

8. An inkjet printing device, comprising the temperature regulating system of claim 1.

9. A temperature regulating system for a fluid ejection device, comprising:
- a fluid reservoir;
- an intermediate fluid container;
- a fluid ejection device;
- a first temperature sensor configured to detect a temperature of fluid in the fluid ejection device;
- a second temperature sensor configured to detect a temperature of the fluid in the intermediate fluid container;
- at least one first fluid communication path for carrying fluid between the fluid reservoir and the intermediate fluid container;
- at least one second fluid communication path for carrying fluid between the intermediate fluid container and the fluid ejection device; and wherein the temperature regulating system causes the fluid not ejected by the fluid ejection device to be carried from the fluid ejection device to the intermediate fluid container via the at least one second fluid communication path, and from the intermediate fluid container to the fluid reservoir via the at least one first fluid communication path, based on the fluid temperatures detected by the first and second temperature sensors to regulate the temperature of the fluid ejection device.

10. The temperature regulating system of claim 9, further comprising a thermally conductive substrate as a component of the fluid ejection device.

11. The temperature regulating system of claim 10, wherein the thermally conductive substrate is thermally coupled to both the fluid ejection device and at least one of the at least one first fluid communication path and the at least one second fluid communication path.

12. The temperature regulating system of claim 10, wherein at least a portion of the at least one second fluid communication path is in contact with the thermally conductive substrate.

13. The temperature regulating system of claim 12, wherein at least a portion of the at least one second fluid communication path is internal to the thermally conductive substrate.

14. The temperature regulating system of claim 9, wherein the temperature regulating system causes the fluid to be carried from the intermediate fluid container to the fluid reservoir when a predetermined temperature is detected by at least one of the first and second temperature sensors.

15. The temperature regulating system of claim 9 wherein the fluid ejection device is a thermal ink jet printhead having at least one die module.

16. An inkjet printing device, comprising the thermal regulating system of claim 9.

17. A temperature regulating method for a fluid ejection device, comprising:

holding fluid in a fluid reservoir;

ejecting fluid from a fluid ejection device;

detecting a-temperature of fluid flowing through the fluid ejection device by first and second temperature sensors, the first temperature sensor detecting a temperature of the fluid in the fluid ejection device, the second temperature sensor detecting a temperature of the fluid in the fluid reservoir;

carrying fluid between the fluid reservoir and the fluid ejection device through at least one fluid communication path; and recirculating fluid not ejected by the fluid ejection device based on the fluid temperatures detected by the first and second temperature sensors to regulate the temperature of the fluid ejection device to be within a predetermined temperature range.

18. The temperature regulating method of claim 17, further comprising thermally coupling a thermally conductive substrate to both the fluid ejection device and the at least one fluid communication path.

19. A temperature regulating method for a fluid ejection device, comprising:

holding fluid in a fluid reservoir;

ejecting fluid from a fluid ejection device;

providing an intermediate fluid container between the fluid reservoir and the fluid ejection device;

detecting temperature of fluid flowing through the fluid ejection device by first and second temperature sensors, the first temperature sensor detecting a temperature of the fluid in the fluid ejection device, the second temperature sensor detecting a temperature of the fluid in the intermediate fluid container;

carrying fluid between the fluid reservoir and the intermediate fluid container and between the intermediate fluid container and the fluid ejection device through at least one fluid communication path; and recirculating fluid not ejected by the fluid ejection device based on the fluid temperatures detected by the first and second temperature sensors to regulate the temperature of the fluid ejection device to be within a predetermined temperature range.

20. The temperature regulating method of claim 19, further comprising thermally coupling a thermally conductive substrate to both the fluid ejection device and the at least one fluid communication path.

* * * * *